United States Patent [19]

Suzuki et al.

[11] 3,977,169

[45] Aug. 31, 1976

[54] SOUND REDUCING DEVICE IN TEXTILE MACHINE

[75] Inventors: Mamoru Suzuki; Yoshiharu Yasui; Kenichi Watanabe, all of Kariya, Japan

[73] Assignee: Kabushiki Kaisha Toyoda Jidoshokki Seisakusho, Kariya, Japan

[22] Filed: July 9, 1975

[21] Appl. No.: 594,433

[30] Foreign Application Priority Data

July 9, 1974 Japan ..... 49-79463

[52] U.S. Cl. ..... 57/1 R; 57/108

[51] Int. Cl.[2] ..... D01H 1/00; G10K 11/04

[58] Field of Search ..... 57/1 R, 34 R, 108, 106; 181/33 R, 33 C, 33 G, 33 GD, 33 K

[56] References Cited

UNITED STATES PATENTS

| | | | |
|---|---|---|---|
| 3,299,624 | 1/1967 | Nimtz | 57/108 |
| 3,430,431 | 3/1969 | Nimtz et al. | 57/108 |
| 3,451,503 | 6/1969 | Twomey | 181/33 R |
| 3,648,449 | 3/1972 | Greive | 57/108 X |
| 3,774,382 | 11/1973 | Bartling | 57/1 R |
| 3,782,087 | 1/1974 | Franzen | 57/1 R |

*Primary Examiner*—Donald E. Watkins

*Attorney, Agent, or Firm*—Wenderoth, Lind & Ponack

[57] ABSTRACT

A sound reducing device in a textile machine including a plurality of spindle assemblies driven by a travelling belt and each forming a balloon of yarn upon rotation thereof. The spindle assembly comprises a first source of noise, which are the travelling belt and the spindle wharves, and a second source of noise, which are the balloon forming sections of the spindle assemblies. The sound reducing device is characterized in that one of the first and second sources of noise is covered by a first sound reducing boundary and the other of the first and second noise sources as well as the first sound reducing boundary is disposed within a second sound reducing boundary.

11 Claims, 6 Drawing Figures

SOUND REDUCING DEVICE IN TEXTILE MACHINE

BACKGROUND OF THE INVENTION

This invention relates to textile machines, such as spinning frames (including ring spinning frames), twisters (including single, double, ring and drawing twisters) and the like, wherein a plurality of spindles are driven and rotated by a traveling belt and a balloon of yarn is formed around the yarn package on each associated spindle upon rotation of the spindle, and more particularly to sound reducing devices in these textile machines.

In general, the textile machine of the type described includes a number of sound sources, by which noise of a relatively high sound level is produced during its operation. It is well known that such a noise comprises mainly sound produced by the travel of the belt, sound of the driving contacts between the travelling belt and the spindle wharves, and sound produced in forming the balloons.

In order to reduce the sound level of such a noise produced by the various sound sources, heretofore, several sound reducing arrangements have been proposed. For example, U.S. Pat. No. 3,782,087 discloses a double twister, wherein a sound reducing cover is provided to cover all of the spindle assemblies each comprising a driving section where the spindle wharves are driven by the travelling belt, and a balloon forming section where a balloon of yarn is formed. British patent specificiation No. 1,030,077 shows a double twist frame, wherein only the contact portions between the travelling belt and the spindle wharves are encased in a single sound reducing cover.

Of these exemplified prior sound reducing devices, the former arrangement has such drawbacks that a satisfactory sound reducing effect cannot be expected unless the sound reducing cover is designed to be of a great thickness; and that undesirable yarn waste produced in the balloon forming sections during ballooning accumulates at the contact portions between the travelling belt and the spindle wharves and at the braked portions of the spindles, causing inconvenience to the driving and braking of the spindles. As is understood, these drawbacks result from the fact that both the balloon forming sections and the spindle driving sections are disposed in the common single sound reducing chamber. With the latter arrangement, since the balloon forming sections of the spindle assemblies, which are the source of high sound level noise, are exposed to the atmosphere in which the double twist frame is arranged, it is not satisfactory for reducing the noise produced by the double twist frame in spite of the provision of the sound reducing cover.

It is therefore an object of this invention to eliminate the above mentioned drawbacks peculiar to the prior art sound reducing devices and to provide an improved sound reducing device in a textile machine having a plurality of spindle assemblies, which can satisfactorily reduce a high level of noise mainly comprising sound of the belt travel, sound of the contacts between the travelling belt and each spindle wharves, and sound produced in forming the balloon at each associated spindle assembly and makes it ensure that yarn waste produced during ballooning is prevented from accumulating at the driven portions of the spindle wharves contact with the belt.

It is another object of this invention to provide a sound reducing device in a textile machine having a plurality of spindle assemblies, which can prevent an occurrence of undesirable mutual interferences in air stream, yarn waste, and hot air, which is produced due to the friction at the driven portions of the spindle wharves, between the adjacent spindle assemblies.

According to the art of sound, sounds produced by various sources of noise are called "composite noise" and, in the case where an intensity of particular sound forming a part of the composite noise is to be measured, the residual sound is called "back ground noise." With respect to relationships between the composite noise and the back ground noise, it is generally acknowledged that when the difference in sound-pressure level between them is 3 db the sound-pressure level of the particular sound is that of the composite noise less 3 db; when the difference is within 4~5 db the level of the particular sound is less than that of the composite noise by 2 db; when the difference is within 6~9 db, the level of the particular sound is less than that of the composite noise by 1 db; and when the difference becomes more than 10 db, the level of the particular sound is substantially identical with that of the composite noise, that is, the back ground noise can be ignored.

The applicants of this invention have found the facts that in the case of the conventional textile machine, such as a double twister without any sound reducing cover, the aforementioned noise consisting of (1) the sound produced by the driving contacts between the travelling belt and the spinning wharves; (2) the sound of the travel of the travelling belt; and (3) the sound produced in the balloon forming sections of the spindle assemblies, where the yarn balloons are formed, is greater in intensity than any other noise by 10 db or more and there is no substantial difference in sound-pressure level between the sound (1) + (2) and the sound (3).

SUMMARY OF THE INVENTION

The applicants have perceived the aforementioned acknowledgement in the sound art the above facts in the textile machine and found that if the sound-pressure level of the sound (1) + (2) or (3) is made greater than the other sound (3) or (1) + (2) by about 10 db or more, the weaker sound can be ignored, resulting in a satisfctory reduction of noise.

With the above and other objects in view, this invention provides a sound reducing device in a textile machine including a plurality of spindle assemblies driven by a travelling belt and each forming a balloon of yarn upon rotation thereof, each spindle assembly comprising a first source of noise, which are the travelling belt and the spindle wharves, and a second source of noise, which are the balloon forming sections of the spindle assemblies, the sound reducing device being characterized by a first sound reducing boundary encapsulating one of the first and second sources of noise and a second sound reducing boundary encapsulating the other of the first and second sources of noise as well as the first sound reducing boundary.

According to one aspect of the invention, the first sound reducing boundary surrounds the first noise source and the second sound reducing boundary encircles the second noise source. The second sound reducing boundary is provided with a plurality of partition members one for each spindle assembly or for a group of spindle assemblies. The partition member extends into between the associated spindle assemblies to partition a portion of one spindle assembly, where a balloon of yarn is formed, from that of the adjacent spindle assembly, whereby a stream of air, yarn waste and hot air existing around or near each spindle assembly are prevented from interfering with those existing around the adjacent spindle assemblies, ensuring effective operation of the textile machine.

BRIEF DESCRIPTION OF THE DRAWINGS

This invention will become more readily apparent from the following detailed description taken in conjunction with the accompanying drawings in which.

DESCRIPTION OF THE EMBODIMENTS

Figure 1:
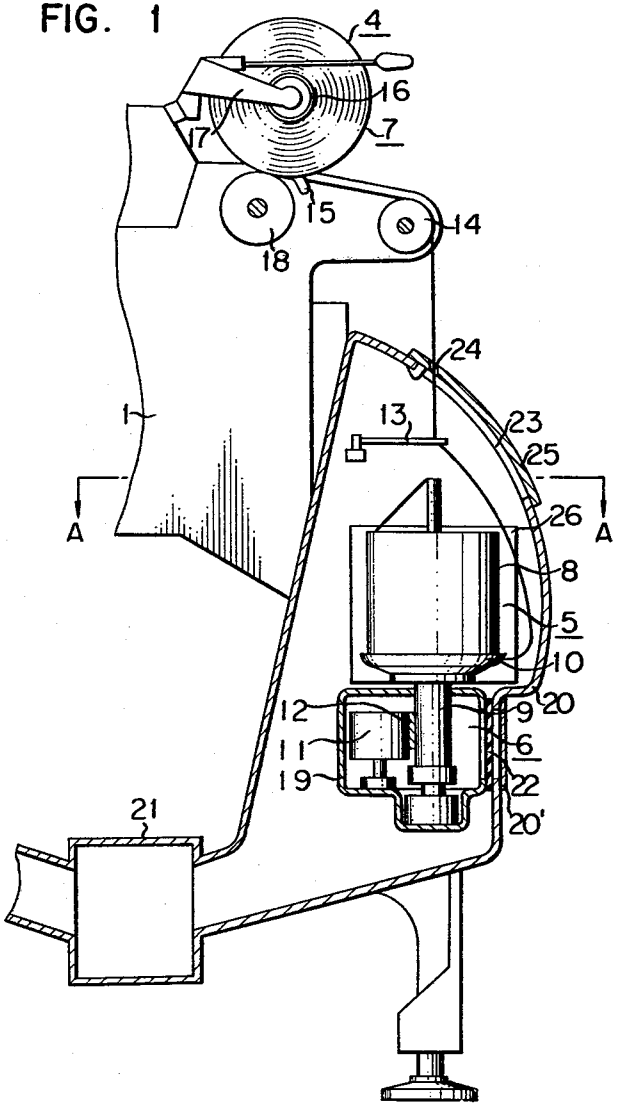
FIG. 1 shows a cross section of the essential parts of a double twister in which this invention is embodied.
Figure 2:
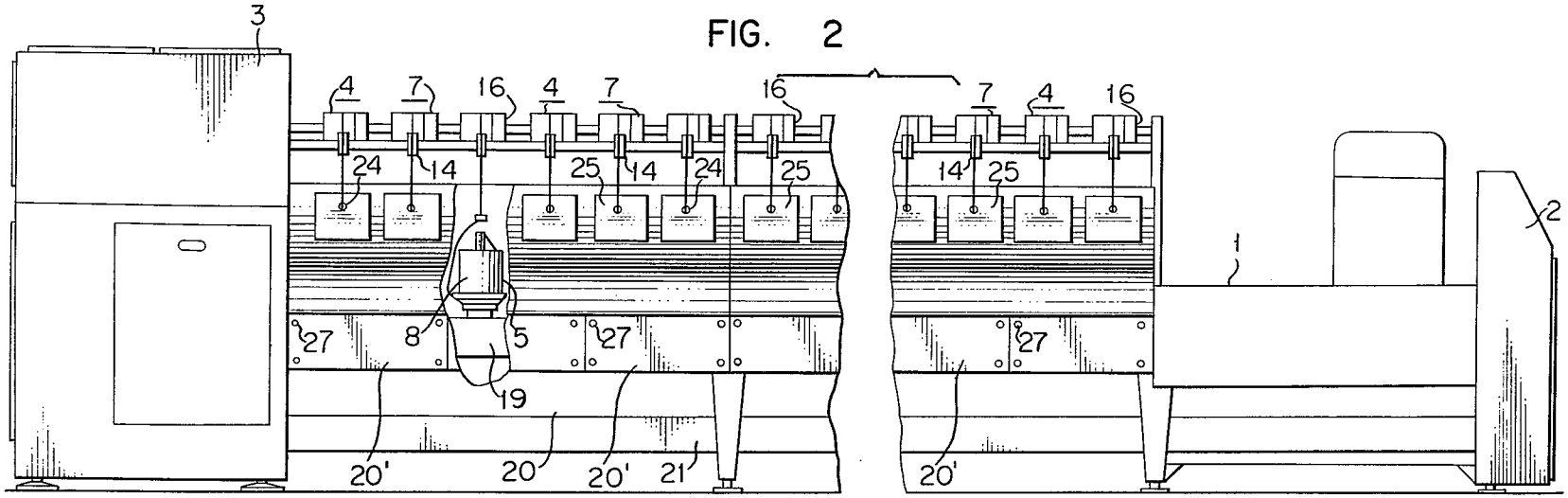
FIG. 2 is a front elevational view of the double twister shown in FIG. 1.

Referring now to the drawings, particularly in FIGS. 1 and 2, there is shown, only by way of example, a double twister provided at its right hand end with a head stock 2 including such as a motor (not shown) and at the left hand end with a gear case 3. A plurality of twisting units 4 are provided on the front side of a twister frame 1 with balloon forming sections 5, driving sections 6 and winding sections 7 as usual. Each balloon forming section 5 and driving section 6 compose a spindle assembly.

The balloon forming section 5 comprises a pot 8 arranged centrally of the twister frame 1 and supporting for rotation a not shown spindle, onto which a supply cheese is fitted. The driving section 6 comprises a spindle wharve 9 fixedly, centrally connected through a rotary plate 10 of the balloon forming section 5 to the lower end of the aforesaid spindle. A driving belt 12 of an endless form is pressed against the cylindrical surfaces of the spindle wharves 9 by a plurality of tension pulleys 11 so that the spindles associated with the spindle wharves 9 can be rotated by the travelling belt 12 at high speed.

Figure 3:
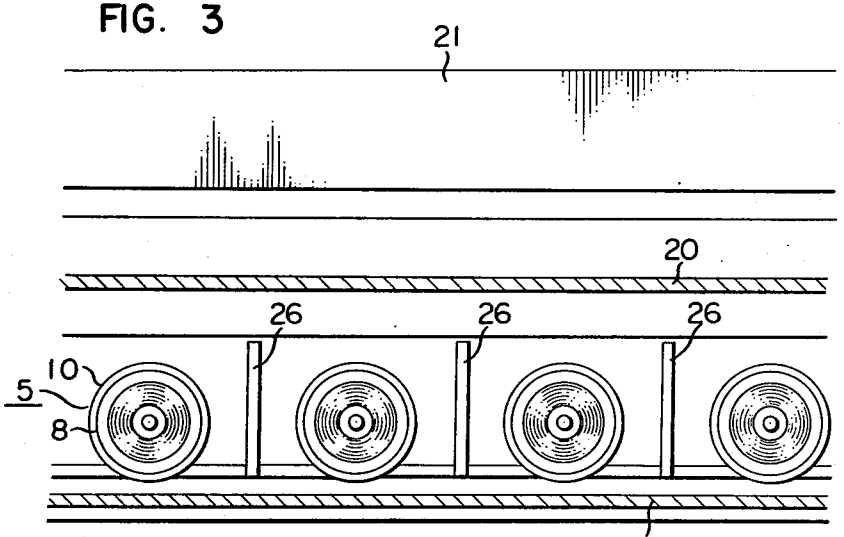
FIG. 3 is a sectional view of the double twister as viewed on the line A — A of FIG. 1.

Between each spindle assembly and the associated winding section 7 is mounted a yarn guide 13 which is movable upwardly and downwardly to smoothly guide the yarn toward the winding section 7. The yarn shown by the dashed and dotted line in FIGS. 1 and 2 and passed through the yarn guide 13 is led upwardly through a guide roller 14 and traversed in a common manner by a traverse guide 15. The winding section 7 has a bobbin holder 17 by which a bobbin 16 is supported for rotation. The rotation of the bobbin 16 is carried out by a driving roller 18 operatively in contact with the bobbin 16. As best shown in FIG. 3, a separator 26 in the form a plate is disposed between the adjacent balloon forming sections 5 of the spindle assemblies to restrain the size of the balloon of yarn.

When the motor in the head stock 2 is actuated, all the twisting units 4 are simultaneously driven through the gearing in the gear box 3. The yarn of the cheese fitted onto the spindle of each balloon forming section 5 is twisted in the balloon forming section 5 and then comes out of the rotary plate 10 of the balloon forming section while forming the balloon around the pot 8 as shown by the dotted and dashed line in FIG. 1 and passes through the yarn guide 13, the guide roller 14 and the traverse guide 15 onto the bobbin 16.

In order to reduce the noise produced by the balloon forming sections 5 and the spindle driving sections 6 of the spindle assemblies, such a sound reducing device is provided which comprises a first sound reducing cover made of suitable sound absorbing or insulating material and fixedly connected to the twister frame therealong so as to cover the whole driving sections 6 including spindle wharve portions at which the spindle wharves 9 contact the travelling belt 12 to be thereby driven. This first cover 19 is designed to reduce the sound produced by the travel of the travelling belt 12 and the operative contacts between the spindle wharves 9 and the travelling belt 12 to become weaker, by 10 db or more in sound-pressure level, than the sound produced by the balloon forming sections 5. A sound-pressure level of noise produced by the source without any sound reducing cover is called hereinafter an "actual sound-pressure level." As is known from FIG. 1, the driving sections 6 are conveniently separated from the balloon forming sections 5 and satisfactorily covered by the first sound reducing cover 19, so that yarn waste produced in the balloon forming sections 5 during ballooning can be prevented from entering the first cover 19 and accumulating at the contact portions of the spindle wharves 9 with the travelling belt 12.

To assist in performing this purpose, there is preferably provided a suitable sealing means, such as an air seal, between a wall of an opening provided in the top of the first cover 19, through which each spindle wharve 9 extends out of the first cover 19, and the cylindrical surface of the associated spindle wharve 9.

The sound reducing device further comprises a second sound reducing cover 20 mounted on the front side of the twister frame 1 to extend therealong. The second cover 20 covers the balloon forming sections 5 of the spindle assemblies as well as the abovedescribed first cover 19, thus reducing the composite noise comprising the noise produced by the driving sections 6, which has already been reduced by the first cover 19, and the noise produced by the balloon forming sections 5.

As shown in FIGS. 1 and 2, the second cover 20 is provided with a plurality of openable plates 20′ connected thereto by screws 27 or otherwise. Portions of the first cover 19 opposite to the plates 20′are formed with openings to that maintenance and inspection of the driving belt 12, the spindle wharves 9, etc., can be allowed only by removing the plates 20′. In this embodiment, the plate 20′ is common to several succeeding spindle assemblies.

In order to collect and vent yarn waste and the like generated in the balloon forming section 5, a suction duct 21 is in communication with the lower back of the second cover 20. The suction duct 21 may be connected to any suitable source of suction and the duct 21 is attached to the twister frame 1 to extend therealong.

In addition, between the first and second covers 19 and 20 near the openable plates 20′, there are vibration absorbing members 22 made of any suitable buffer material, such as rubber. The absorbing member 22 prevents the direct transmission of noise and vibration of the driving sections 6 to the second sound reducing cover 20. Therefore, in the case where there is a considerable clearance between the first and second covers 19 and 20, these vibration absorbing members 22 can be removed.

As best shown in FIG. 1, a plurality of openings 23 are provided one for each spindle assembly in the upper wall of the second cover 20 and a plurality of openable hatches 25 with through yarn openings 24 cover the corresponding openings 23. These openings 23 allow access by the operator to supply the cheeses into the pots 8 and to inspect the interior of the second cover 20.

Thus, it is noted that the noise of the belt travel and the contacts of the travelling belt 12 with the spindle wharves 9 is reduced by the first sound reducing cover 19 to the sound-pressure level less than the actual sound-pressure level of the noise produced by the balloon forming sections 5 by 10 db or more. This means that the sound-pressure level of the composite noise comprising the noise produced by the balloon forming sections 5 and the noise produced by the driving sections 6 substantially does not exceed the actual sound-pressure level of the noise produced by the balloon forming sections 5. The above composite noise is further reduced by the second sound reducing cover 20, resulting in satisfactory elimination of the noise produced by the double twister.

From the foregoing, it is understood that the invention provides a textile machine wherein ones of the driving sections and the balloon forming sections of the spindle assemblies are encapsulated in the first sound reducing boundary forming means to provide a predetermined sound-pressure level difference (10 db or more) between the now reduced noise produced by the said ones and the noise produced by the others, and the others of the driving sections and the balloon forming sections as well as the first sound reducing boundary forming means are covered by the second sound reducing boundary forming means. Such a textile machine provides good sound reducing effectiveness as compared with the prior art textile yarn processing machines as disclosed in U.S. Pat. No. 3,782,087 and British patent specification No. 1,030,077.

In this respect, it must be stressed that, although the sound reductions resulting from weakening the sound-pressure level of the back ground noise (the noise produced by the driving sections 6) relative to the particular noise (the noise produced by the balloon forming sections 5) is only 3 db in sound-pressure level as mentioned above, the operator will feel very quietly the noise reduced by 3 db.

In addition, it is possible to flow a stream of cooling air through the inside of the first sound reducing cover 19, thus cooling the spindle driving sections 6.

Figure 6:
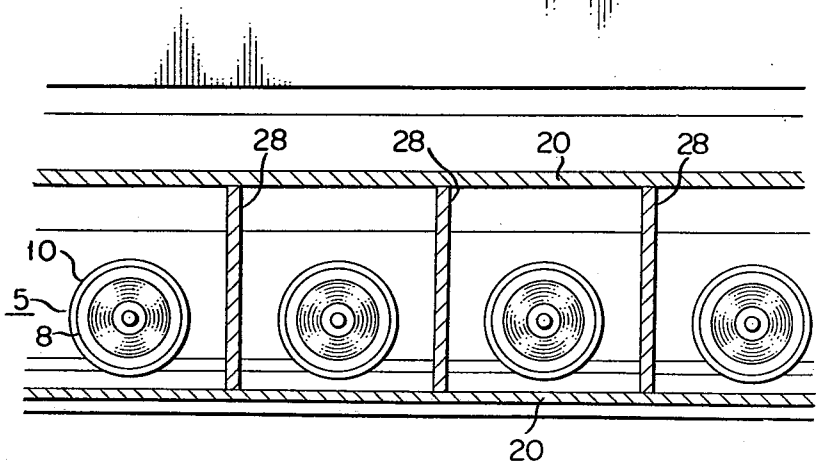
FIG. 6 is a sectional view of the modified double twister as viewed on the line B — B of FIG. 4.
Figure 5:
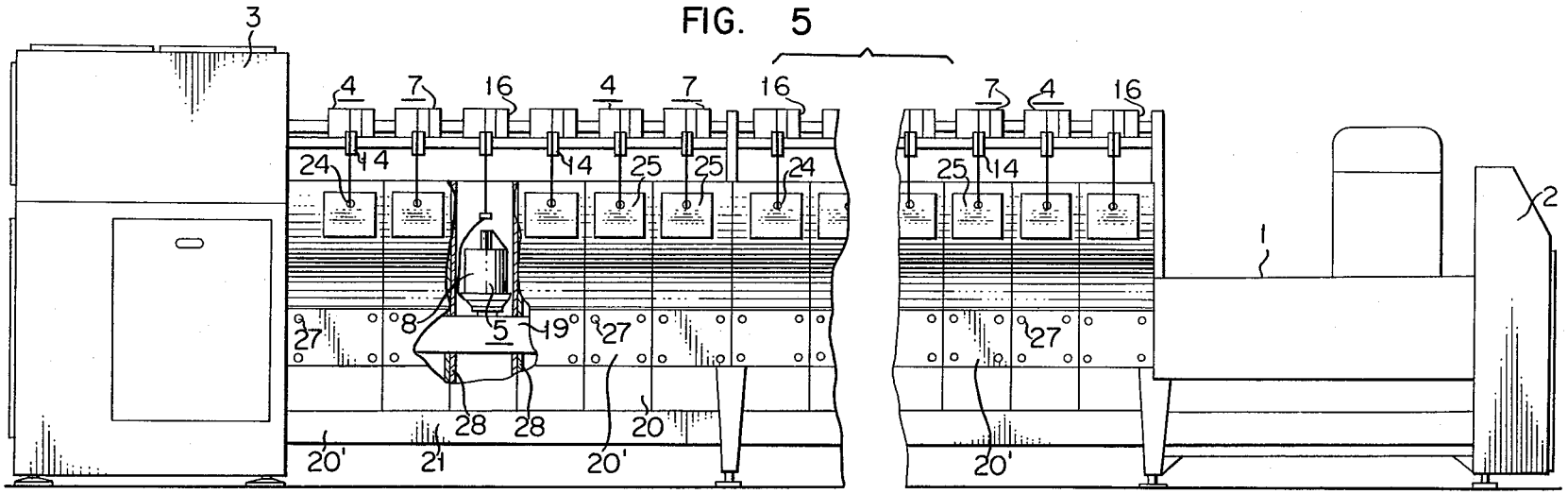
FIGS. 4 and 5 are views corresponding to FIGS. 1 and 2, respectively and showing another modification of the invention.
Figure 4:
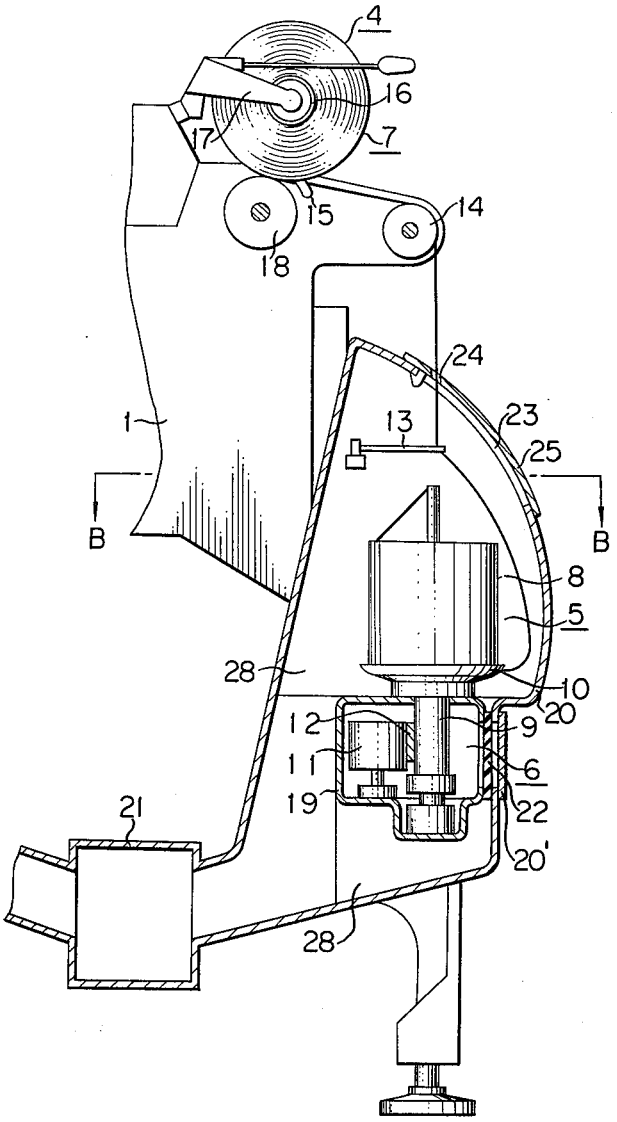

FIGS. 4 to 6 show another embodiment of the invention, wherein the second sound reducing cover 20 with side walls 28 is provided one for each spindle assembly. The side wall 28 extends downwardly between the adjacent spindle assemblies to separate one balloon forming section from the other. Also, the openable plate 20' is provided one for each sound reducing cover 20. The space defined by each sound reducing cover 20 is connected to the suction duct 21. In this embodiment, when the particular hatch 25 over the opening 23 is opened to supply the cheese for the balloon forming section 5, the noise produced in the adjacent balloon forming sections is prevented from being propagated through the opening 23 in question out of the sound reducing cover. The separating feature of the side wall 28 has an advantage that air stream, yarn waste and hot air all produced in the particular spindle assembly is prevented from interfering with that in the adjacent spindle assemblies. The lower portion of the side wall 28 below the top of the first cover 19 may be omitted.

While the invention has been illustrated and described with reference to two preferred embodiments thereof, it is to be understood that various changes in the details of constructions and the arrangement and combination of parts may be made without departing from the spirit and scope of the invention.

What we claim is:

1. A device for reducing sound produced by a textile machine including a travelling belt, and a plurality of spindle assemblies, each spindle assembly comprising a first section where a spindle wharve of said each spindle assembly is in contact with and driven by said travelling belt, and a second section where a balloon of yarn is formed, said sound reducing device comprising means for forming a first sound reducing boundary covering ones of said first and second sections, and means for forming a second sound reducing boundary covering the others of said first and second sections as well as said first boundary forming means.

2. A sound reducing device according to claim 1, wherein said first boundary forming means covers said first sections of said spindle assemblies and said second boundary forming means covers said second sections of said spindle assemblies.

3. A sound reducing device according to claim 2, wherein said second boundary forming means is in communication with a suction duct means to collect and vent yarn waste produced in said second sections.

4. A sound reducing device according to claim 2, wherein said second boundary forming means is formed, at portions above the second sections, with openings through which cheeses are supplied for the corresponding second sections of said spindle assemblies.

5. A sound reducing device according to claim 4, wherein said openings are normally closed by hatch means.

6. A sound reducing device according to claim 5, wherein portions of said second boundary forming means positioned on the front side of the textile machine and near said first sections are openable and portions of said first boundary forming means opposed to the portions of said second boundary forming means are also openable.

7. A sound reducing device according to claim 6, wherein a vibration absorbing member is provided between each of said portions of said second boundary forming means and each of said portions of said first boundary forming means to prevent sound and vibration of each first section of the corresponding spindle assembly from being transmitted directly to said second boundary forming means.

8. A sound reducing device according to claim 1, wherein each of said first and second boundary forming means comprises a single sound reducing cover mounted on the textile machine to extend along a length thereof.

9. A sound reducing device according to claim 2, wherein said second boundary forming means has a plurality of downwardly extending partition walls to divide the upper space defined by said second boundary into compartments in which said second sections of the spindle assemblies are positioned one for each compartment.

10. A sound reducing device according to claim 2, wherein said second boundary forming means has a plurality of downwardly extending partition walls to divide the upper space defined by said second boundary into compartments in each of which a group of said second sections of said spindle assemblies are positioned.

11. A sound reducing device according to claim 1, wherein said first boundary forming means provides a sound-pressure level difference of 10 db or more between noise produced by said ones of said first and second sections and reduced by said first boundary forming means and noise produced by the others of said first and second sections.

* * * * *